US005681143A

United States Patent [19]

Ratner

[11] Patent Number: 5,681,143

[45] Date of Patent: Oct. 28, 1997

[54] DAMPER CONTROL SYSTEM FOR CENTRIFUGAL FAN

[75] Inventor: David A. Ratner, Healdsburg, Calif.

[73] Assignee: Brod & McClung—Pace Co., Portland, Oreg.

[21] Appl. No.: 562,146

[22] Filed: Nov. 22, 1995

[51] Int. Cl.[6] ..... F04D 15/00

[52] U.S. Cl. ..... 415/158; 415/148

[58] Field of Search ..... 415/148, 150, 415/158, 128

[56] References Cited

U.S. PATENT DOCUMENTS

| | | | |
|---|---|---|---|
| 490,922 | 1/1893 | Pelzer | 415/148 |
| 1,604,328 | 10/1926 | Walker . | |
| 1,725,344 | 8/1929 | Dennis | 415/158 |
| 1,787,652 | 1/1931 | Anderson | 415/158 |
| 2,814,431 | 11/1957 | Darrow et al. | 415/158 |
| 4,135,850 | 1/1979 | d'Anjou . | |
| 5,161,941 | 11/1992 | Ratner . | |

FOREIGN PATENT DOCUMENTS

| | | | |
|---|---|---|---|
| 41436 | 3/1937 | Netherlands | 415/158 |

OTHER PUBLICATIONS

"Varimark II" brochure re air volume control device for centrifugal fans (three pages) (undated).

"Econo–Sleeve" No. 83–46253–05, by Pace Co. (two drawings) (Sep. 15, 1994).

*Primary Examiner*—John T. Kwon

*Attorney, Agent, or Firm*—Klarquist Sparkman Campbell Leigh & Whinston, LLP

[57] ABSTRACT

A centrifugal fan having a damper control system located away from the air flow path is disclosed. The control system includes a rotatable shaft located outside of a fan housing wherein rotation of the control shaft actuates a plurality of shafts and rods to move an annular damper located within the housing into an open position away from the centrifugal fan blades and to a closed position coaxially over the fan blades thus substantially restricting the flow of air through the centrifugal fan. The dampers are mounted for translation on two support rods located on opposite sides of the centrifugal fan. The dampers ride on a support system including a plurality of ball bearings that are in tangential contact with the support rods thus providing high-pressure contact surfaces between the bearings and the support shafts which act to keep the path of travel of the bearings on the rods free of debris so that the dampers have unobstructed motion between the open and closed positions.

19 Claims, 5 Drawing Sheets

DAMPER CONTROL SYSTEM FOR CENTRIFUGAL FAN

BACKGROUND OF THE INVENTION

1. Field of the Invention

This invention pertains to centrifugal fans and more particularly pertains to a system for controlling air output from centrifugal fans.

2. Description of the Related Art

Centrifugal style fans are suitable for commercial applications because they efficiently move large volumes of air. Centrifugal fans are typically enclosed by a housing with one or two inlets and a single outlet. Within the housing is a fan wheel having a circular cross-section with fan blades that are radially oriented so that as the fan wheel rotates air is drawn into the center of the fan along the fan's axis of rotation and is impelled radially outward. Centrifugal fans are typically rotated by a constant speed motor to conserve energy.

One method of adjusting air flow from a centrifugal motor is an annular damping shroud that is mounted coaxially with the rotating fan wheel and which can move along the fan's axis of rotation so as to move into a position over the fan wheel thereby blocking the discharge of air from the fan wheel. When thusly covered, the fan is not moving substantial air nor doing substantial work, thus the load on the fan motor is decreased.

Various devices have been devised for moving the dampers into the "open" and "closed" positions. One prior art system uses linkages in a scissor-lever arrangement, located in front of a fan inlet, which can be operated to move coaxial dampers along support rods. However, centrifugal fans are very sensitive to obstructions in their air flow path and such systems reduce the efficiency of centrifugal fans because they interfere with air flow. Additionally, some prior art systems become inoperable after many hours of operation because dirt or other airborne contaminates gum up the works.

SUMMARY OF THE INVENTION

Accordingly, what is needed is a control system for moving annular dampers into their open and closed positions with a minimum of interference of the air flow path and in a way that will work reliably even when airborne dirt contaminates the control system.

The present invention addresses the aforementioned problems by providing a control system for moving damping shrouds that does not interfere with the air flow path. Further, the present invention provides a support system for the shrouds which permit the shrouds to move along a direction parallel to the axis of rotation of the fans and which will work reliably even if substantial airborne particles contaminate the system.

The control system incorporates a rotatably mounted control shaft that actuates a plurality of linkages to push or pull the shrouds along their support system so as to move the shrouds into open or closed positions. In the preferred embodiment, the plurality of linkages include a first bar connected to the control shaft which is further connected to a transfer shaft that passes through the fan housing wall. Rotation of the transfer shaft rotates a second and third bar coupled to the shroud. In an embodiment having a double fan wheel centrifugal fan, the control shaft is connected to two separate plurality of linkages so that both shrouds are moved simultaneously, and in opposite directions, when the control shaft is rotated.

The shrouds are preferably supported by two support rails located on opposite sides of the fan wheels. The shrouds are connected to support plates which are located over the support rails. Each support plate contains a plurality of ball bearings which press against the rail. The bearings and rail shapes are chosen and are oriented so that the area of contact between the bearings and the rail is very small thus creating high pressure contact. This high-pressure, small-surface-area contact between the bearings and the support rail assist in pushing away any contaminates that might attach to the rail. Accordingly, the shrouds can travel freely between their open and closed positions even when airborne contaminates have settled on, and sullied, the surfaces of the control system and shroud supports.

Various advantages and features of novelty which characterize the invention are particularized in the claims forming a part hereof. However, for a better understanding of the invention and its advantages, reference should be had to the drawings and to the accompanying description in which there is illustrated and described preferred embodiments of the invention.

BRIEF DESCRIPTION OF THE DRAWINGS

FIG. 1 shows an air inlet in the housing.

DETAILED DESCRIPTION OF THE PREFERRED EMBODIMENTS

Figure 1:
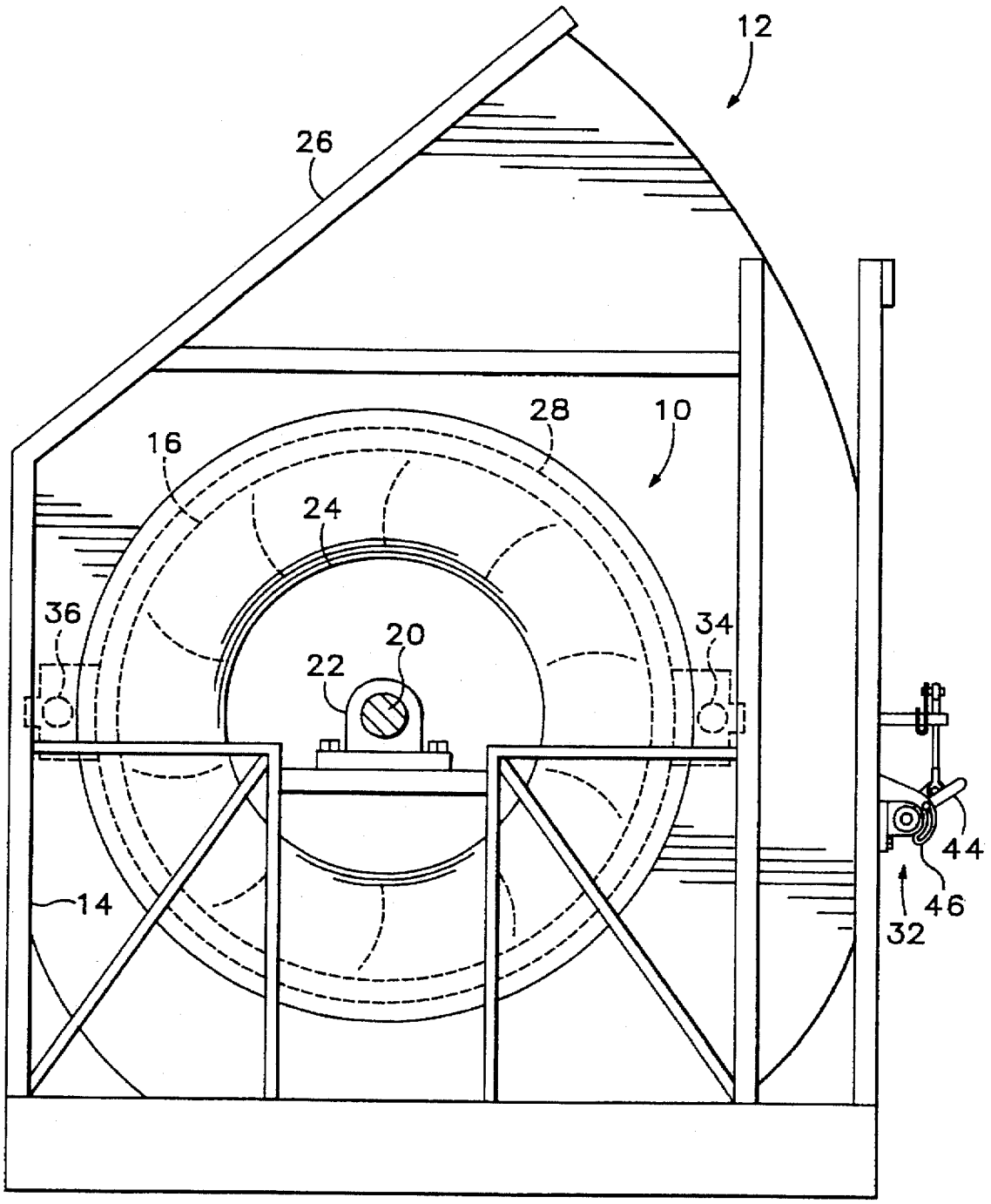
FIG. 1 is an end elevation view of a fan housing and centrifugal fan having a damper control system in accordance with a preferred embodiment of the present invention.
Figure 2:
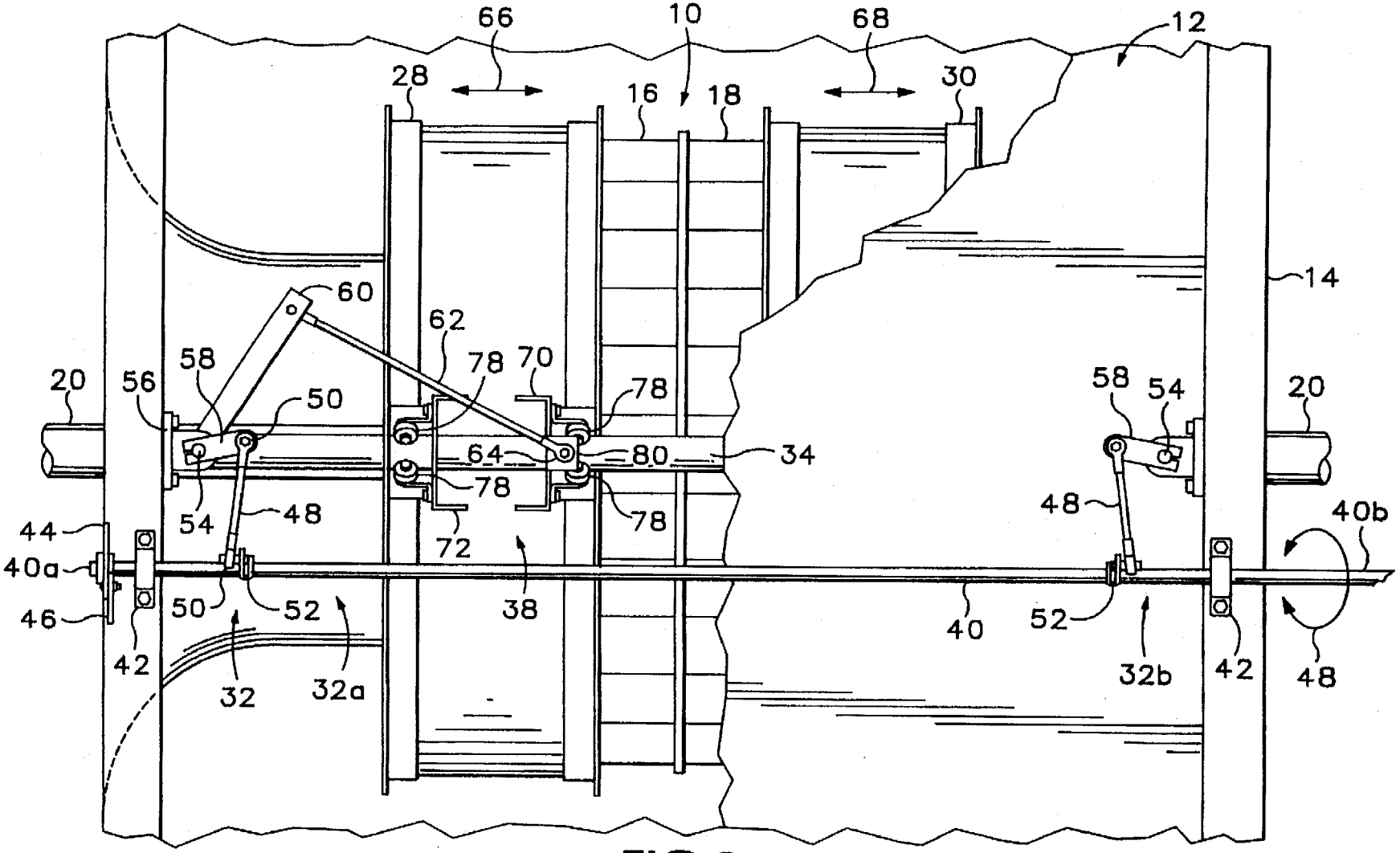
FIG. 2 is a partially-cutaway, enlarged, front elevation view showing details of annular dampers and a control system of the present invention.

With reference to FIGS. 1 and 2 there is shown a centrifugal fan 10 located in a housing 12 that is supported by a frame 14. The centrifugal fan 10 includes two fan wheels 16 and 18 that are mounted on a drive shaft 20 that is rotatably supported by bearings 22 on the frame 14. The drive shaft 20 is connected to a motor (not shown) that rotates the drive shaft thereby rotating the fan wheels 16 and 18.

The housing 12 includes air inlets 24 (only one is shown in the figures) and an air outlet 26. When the centrifugal fan is rotating, air is drawn in through the air inlets 24 at both ends of the housing 12. Thus, air enters substantially parallel to the axis of rotation, which is defined by drive shaft 20. The air is then propelled radially through the fan wheels 16 and 18 and exits through the housing outlet 26.

To control the volume of air flowing through the centrifugal fan 10, annular dampers (also called damping shrouds) 28 and 30 are mounted within the housing 12 such that they may be moved into position coaxially over the fan wheels 16 and 18 to close the flow of air, and to the side so as not to cover the fan wheels thus opening the fan. The annular dampers 28, 30 may also be located at any point between the open and closed positions. When the dampers 28, 30 are completely covering the fan wheels 16, 18 the air flow from the centrifugal fan is negligible. When the dampers 28, 30 are located away from the fan wheels 16, 18 a maximum amount of air flow passes through the centrifugal fan 10.

The dampers are supported on support rods 34, 36 by support structures 38. The rods 34 and 36 are located on two sides of the fan wheels 16, 18, approximately level with the drive shaft 20.

The annular dampers 28, 30 are moved by a damper control system 32 shown in FIGS. 2–5. A control shaft 40 is rotatably mounted in bearings 42 that are attached to the frame 14. At one end 40*a* of the control shaft 40 is a handle 44 that can be used to manually rotate the control shaft 40. A handle guide 46 (FIG. 1) limits the amount of rotation of the handle 44 so that the extreme positions of the handle correlate with the closed and open positions of the dampers 28, 30. The control shaft 40 may also be connected to an automatic control apparatus at an end 40*b* so that the system may be coupled to an electronic control system (not shown). The control shaft 40 rotates about its own longitudinal axis as represented by the arrow 48 (FIG. 2).

The control shaft 40 is connected to a first rod 48 having rod end bearings 50 at each end thereof. A moment arm coupler 52 interconnects the first rod 48 with the control shaft 40. Thus, rotation of the control shaft 40 causes the first rod 48 to translate substantially along its longitudinal axis. Note that due to the moment arm coupler 52, there is some (end-over-end type) rotation of the first rod 48.

The first rod 48 is also connected to a transfer shaft 54 which passes through the housing 12 and is rotatably coupled to the housing by bearings 56. The first rod 48 and the transfer shaft 54 are interconnected by a moment arm coupler 58. Because of their connection through the coupler 58, translation of the first rod 48 causes the transfer shaft 54 to rotate about its longitudinal axis.

The rotation of the transfer shaft 54 is communicated to a second plate-like bar 60 located within the housing 12. Thus, as the transfer shaft 54 rotates, the second bar 60 likewise rotates (like the hand of a clock). Second bar 60 is directly attached to the transfer shaft 54.

Coupled to the second bar 60 is a third bar 62 which includes rod-end bearings 64 at each end thereof. Another end of the third bar 62 is coupled to a damper 28 or 30 so that movement of the third bar 62 causes one damper 28 or 30 to move along the support rods 34 and 36. The dampers 28, 30 translate along the axis of the fan's rotation as represented by arrows 66, 68, respectively (FIG. 2).

Figure 3:
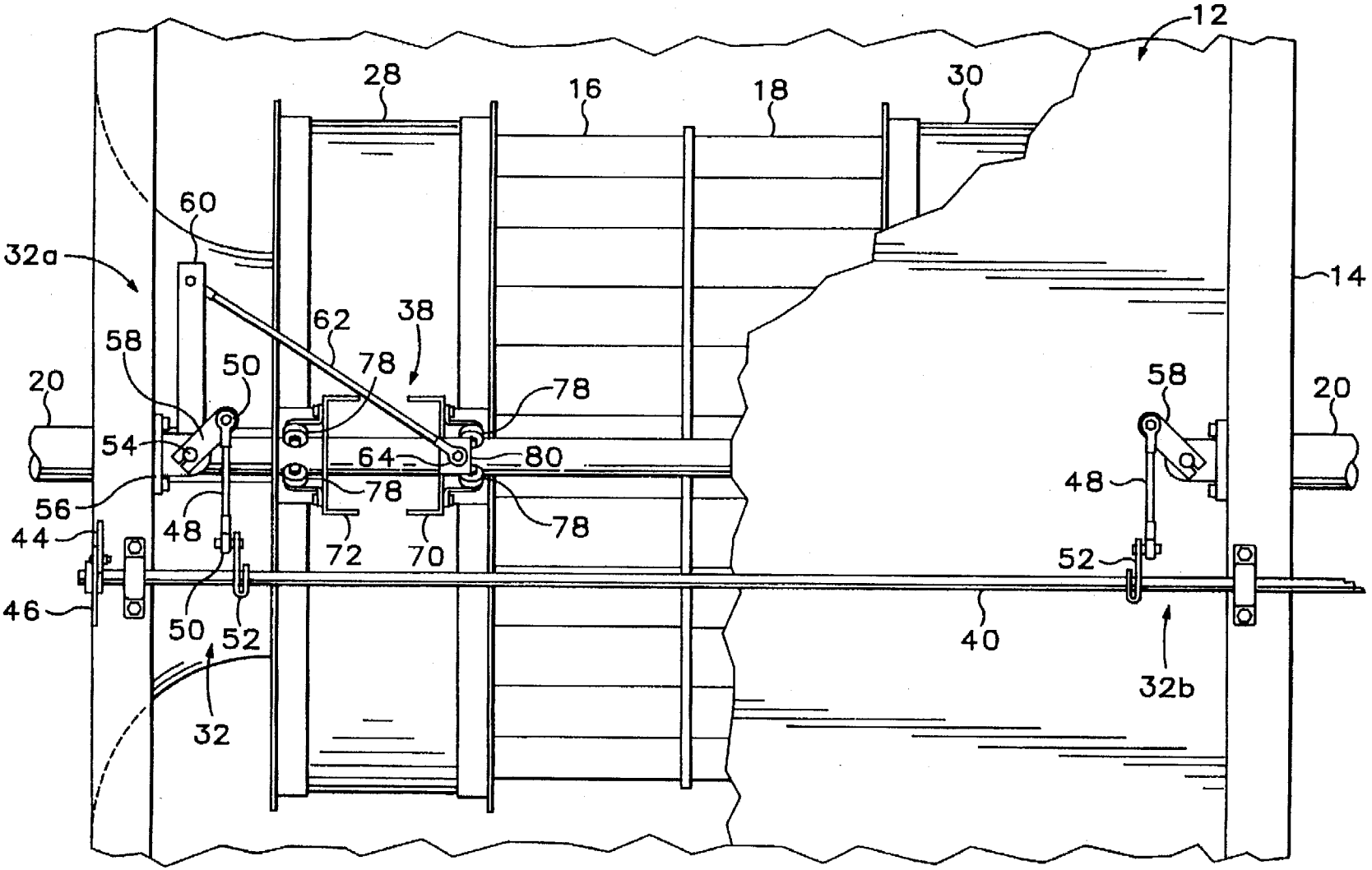
FIG. 3 is the view of FIG. 2 wherein the control system has been actuated to move the annular dampers to a different location.
Figure 4:
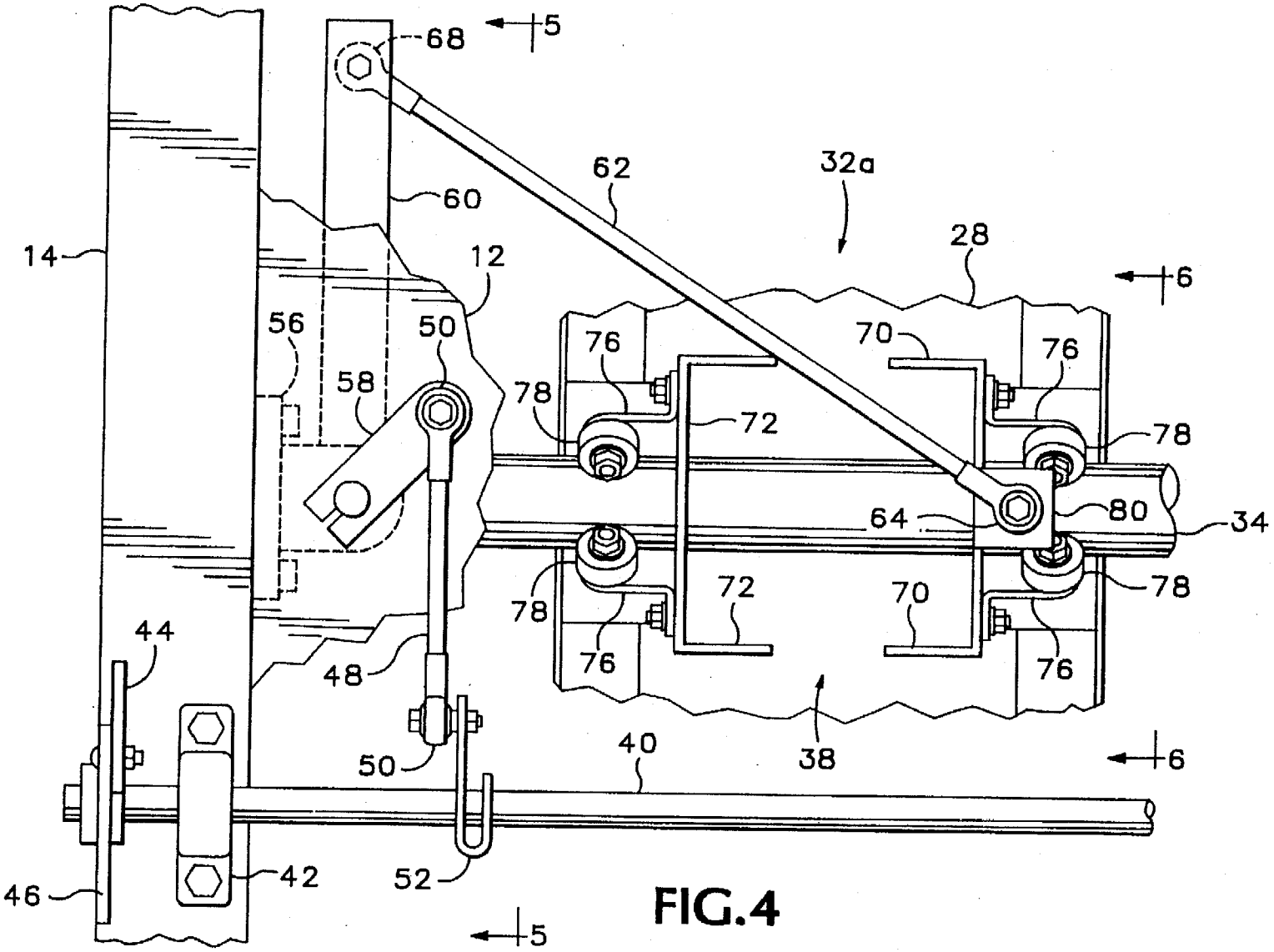
FIG. 4 is a further enlarged front elevation view showing the control mechanism of the present invention.
Figure 5:
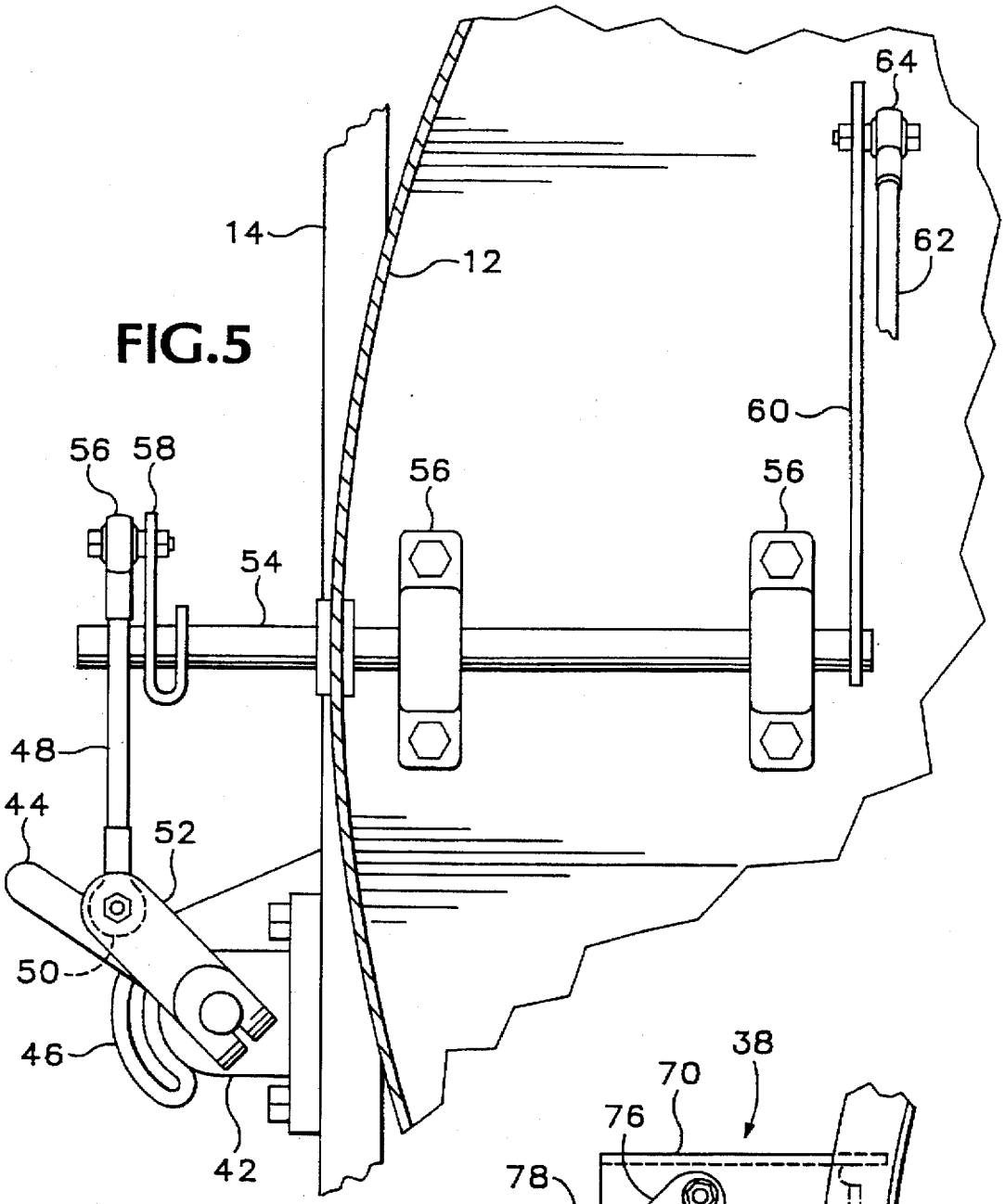
FIG. 5 is a cross-section view taken along lines 5—5 of FIG. 4.
Figure 6:
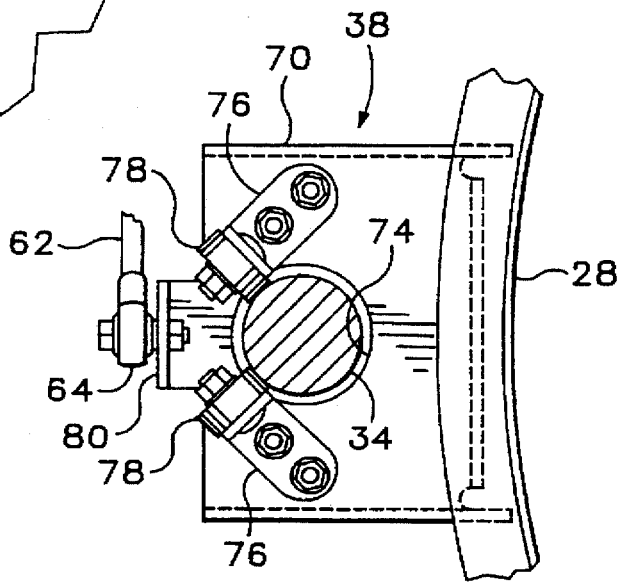
FIG. 6 is a cross-section view taken along lines 6—6 of FIG. 4.

Summarizing, rotation of the control shaft 40 causes the first rod 48 to translate (and slightly rotate) which in turn causes the transfer shaft 54 to rotate thus rotating the second bar 60 which causes the third bar 62 to rotate and translate thus moving a damper 28 or 30 to translate along the fan's axis of rotation so as to cover or uncover the fan wheels 16 or 18. In FIG. 3 the dampers are shown in their "open" positions wherein they do not substantially cover the fan wheels 16, 18. In FIG. 2 the dampers are shown partially covering the fan wheels thus blocking and reducing air flow through the fan 10.

The control system 32 includes a plurality of linkages 32*a*, 32*b* for each damper 28, 30, respectively. Each plurality of linkages is connected to the control shaft 40 and arranged such that rotation of the control shaft 40 moves both plurality of linkages 32*a*, 32*b* which in turn move the dampers in opposite directions. Thus, rotation of the control shaft 40 in a first direction of rotation will cause the dampers 28 and 30 to translate in a first direction of translation (for example, toward one another so as to shroud the fan wheels 16, 18) and rotation of the control shaft 40 in an opposite direction of rotation will move the dampers 28, 30 in a second direction of translation (i.e., away from each other, toward the open position).

The control system 32 of the present invention is located outside of the air flow path of the centrifugal fan 10. That is, none of the plurality of linkages 32*a*, 32*b* or the control rod 40 is located along an inflow or outflow air flow path of the centrifugal fan.

As noted, the dampers 28, 30 are carried by support structures 38 that are mounted on the support rods 34 and 36. As best shown in FIGS. 2–4 and 6, the dampers 28, 30 are coupled to support plates 70, 72. Each support plate 70, 72 includes a central opening 74 (FIG. 6) for receiving the support rods 34, 36.

The support plates 70, 72 provide an attachment for bearing holders 76 which support bearings 78. Preferably, bearings 78 are ball bearings having an inner race securely coupled to the bearing holder 76 and an outer race positioned to ride on the support rods 34 or 36. Accordingly, the dampers 28 and 30 are supported on the support rods 34 and 36 by the bearings 78. The bearings 78 are arranged in tangential contact with the support rods 34 and 36 to provide a high-pressure point-of-contact between the bearings 78 and the support rods 34 and 36 so that any dirt or debris that accumulates on the rods 34, 36 is forced off of the path as the bearings 78 move along the rods. Thus, accumulation of debris within the housing does not substantially affect the motion of the dampers between their open and closed positions.

The support plates 70 and 72 are substantially similar except that support plates 70 includes a rod-connecting portion 80 that is coupled to the third bar 62. Accordingly, rotation of the control shaft 40 acts through the plurality of linkages so that the translation of the third bar 62 acts on the support plate 70 thus moving a damper 28 or 30.

As shown, the control system 32 includes some bars and shafts located outside of the housing 12 while other bars and shafts are located within the housing. Alternative configurations may include a different combination of bars and shafts within and without the housing 12. Alternatively, the control system 32 may be used with an alternative support system 38 and the support system 38 may be used with alternative control systems 32. In addition, the control system and support system described herein can be used with centrifugal fans having single or multiple fan wheels.

Numerous characteristics and advantages of the invention have been set forth in the foregoing description, together with details of the structure and function of the invention. The novel features hereof are pointed out in the appended claims. The disclosure is illustrative only, and changes may be made in detail, especially in matters of shape, size, and arrangement of parts within the principle of the invention to the full extent indicated by the broad general meaning of the terms in the claims.

I claim:

1. A centrifugal fan system, comprising:

(a) a centrifugal fan and a power source for rotating the fan about an axis of rotation;

(b) a first damper shroud disposed coaxially about the axis of rotation, the first damper being translatable along the axis of rotation;

(c) a housing enclosing the fan and first shroud, the housing including an inlet port for allowing air from an ambient atmosphere into the fan and an outlet port for discharging air from the fan thereby defining an air flow path from the inlet port through the fan to the outlet port;

(d) a first shaft rotatably coupled to the housing; and (e) a damper actuation system coupled to the first shaft and the first damper wherein rotation of the first shaft actuates the damper actuation system thereby moving the first shroud, wherein the damper actuation system includes a first bar coupled to the first shaft, a second shaft coupled to the first bar, the second shaft passing through the housing, a second bar coupled to the second shaft, and a third bar coupled to the second bar and the first shroud wherein rotation of the first shaft rotates and translates the first bar thereby rotating the second shaft thereby rotating the second bar thereby rotating and translating the third bar thereby moving the first shroud.

2. The fan system of claim 1 further comprising a first torque arm coupled to the first shaft and the first bar so that rotation of the first shaft rotates the first torque arm and thereby rotates and translates the first bar.

3. The fan system of claim 2 further comprising a second torque arm coupled to the first bar and the second shaft whereby translation of the first bar rotates the second torque arm thereby rotating the second shaft.

4. A damper control system for a centrifugal blower having a centrifugal fan, at least one cylindrical damper shroud supported for translation to a position substantially coaxial with the fan so as to permit minimum air flow and a position proximate the fan so as to permit maximum air flow, and a housing enclosing the fan and shroud, the housing including an inlet for ingress of air and an outlet for egress of air, the control system comprising:

(a) a first shaft rotatably coupled to the housing and rotatable relative thereto;

(b) a first bar coupled to the first shaft wherein rotation of the first shaft translates the first bar;

(c) a second shaft extending through the housing and rotatable relative thereto, the second shaft coupled to the first bar such that translation of the first bar rotates the second shaft;

(d) a second bar coupled to the second shaft for rotation therewith; and (e) a third bar coupled to the second bar and the shroud, wherein rotation of the first shaft translates the first bar thereby rotating the second shaft, thereby rotating the second bar thereby moving the third bar thereby moving the shroud so as to control the volume of air discharged by the fan.

5. The damper control system of claim 4 further comprising a first torque arm fixedly coupled to the first shaft for rotation therewith, the first torque arm further coupled to the first bar.

6. The damper control system of claim 5 further comprising a second torque arm fixedly coupled to the second shaft for rotation therewith, the second torque arm further coupled to the first bar.

7. The damper control system of claim 4 wherein the first bar, second shaft, second bar, and third bar are located at a first side of the housing and further comprising a second cylindrical damper shroud and a second-side first bar, second-side second shaft, second-side second bar, and second-side third bar wherein the second-side first bar is coupled to the first shaft and rotation of the first shaft moves the first-side first bar and the second-side first bar and rotates the first-side second shaft and the second-side second shaft and rotates the first-side second bar and the second-side second bar and moves the first-side third bar and the second-side third bar, respectively, thereby moving both shrouds simultaneously and in different directions.

8. The damper control system of claim 4 wherein the blower defines an air path starting at the inlet and extending through the fan to the outlet and wherein the first shaft, the first bar, the second shaft, the second bar, and the third bar are not located within the air flow path.

9. A centrifugal fan system, comprising:

(a) a centrifugal fan and a power source for rotating the fan about an axis of rotation;

(b) a first damper shroud disposed coaxially about the axis of rotation, the first damper being translatable along the axis of rotation;

(c) a housing enclosing the fan and first shroud the housing including an inlet port for allowing air from an ambient atmosphere into the fan and an outlet port for discharging air from the fan thereby defining an air flow path from the inlet port through the fan to the outlet port;

(d) a first shaft rotatably coupled to the housing;

(e) a damper actuation system coupled to the first shaft and the first damper wherein rotation of the first shaft actuates the damper actuation system thereby moving the first shroud; and (f) a bearing-rail support system for supporting the first shroud and upon which the first shroud translates, wherein the bearing-rail support system comprises a rail fixedly coupled to the fan system and a plurality of bearings arranged to press against the rail, the bearings being rotatably coupled to the first shroud.

10. A centrifugal fan system, comprising:

(a) a centrifugal fan and a power source for rotating the fan about an axis of rotation;

(b) a first damper shroud disposed coaxially about the axis of rotation, the first damper being translatable along the axis of rotation;

(c) a housing enclosing the fan and first shroud the housing including an inlet port for allowing air from an ambient atmosphere into the fan and an outlet port for discharging air from the fan thereby defining an air flow path from the inlet port through the fan to the outlet port;

(d) a first shaft rotatably coupled to the housing;

(e) a damper actuation system coupled to the first shaft and the first damper wherein rotation of the first shaft actuates the damper actuation system thereby moving the first shroud; and (f) a bearing-rail support system for supporting the first shroud and upon which the first shroud translates wherein the bearing-rail support system comprises a rail, a bearing support plate, and a plurality of bearings, the rail being fixedly coupled to the housing, the support plate being fixedly coupled to the first shroud and the plurality of bearings being rotatably coupled to the support plate.

11. The fan system of claim 10, wherein the support plate includes a hole sized to receive the rail, the bearings being arranged on the support plate to press against the rail when the rail is received within the support plate hole.

12. A centrifugal fan system, comprising:

(a) a centrifugal fan and a power source for rotating the fan about an axis of rotation;

(b) a first damper shroud disposed coaxially about the axis of rotation, the first damper being translatable along the axis of rotation;

(c) a housing enclosing the fan and first shroud the housing including an inlet port for allowing air from an ambient atmosphere into the fan and an outlet port for discharging air from the fan thereby defining an air flow path from the inlet port through the fan to the outlet port;

(d) a first shaft rotatably coupled to the housing;

(e) a damper actuation system coupled to the first shaft and the first damper wherein rotation of the first shaft actuates the damper actuation system thereby moving the first shroud; and (f) a bearing-rail support system for supporting the first shroud and upon which the first shroud translates, wherein the bearing-rail support system comprises two rails located at opposite sides of the first shroud, four support plates fixedly coupled to the first shroud, the support plates include a hole, each rail being received within the hole of two support plates, each support plate also having two bearings rotatably coupled thereto, the bearings being in contact with the rail.

13. The fan system of claim 12 wherein the rails are substantially cylindrical and the bearings are located on the rails, circumferentially spaced apart by substantially ninety degrees.

14. A damper system for controlling a volume of air flow out of a housing having a centrifugal fan that rotates about a rotation axis, comprising:

(a) two support shafts;

(b) a damping shroud supported by the support shaft and movable from a cover position coaxially about the centrifugal fan to a noncover position proximate the fan or any position therebetween so as to provide partial cover about the fan thereby permitting or blocking air flow;

(c) an elongate control shaft rotatably mounted proximate the shroud; and (d) a plurality of linkages operatively connecting the control shaft to the shroud whereby rotation of the control shaft about its longitudinal axis causes the shroud to translate along the support shaft so as to cover a greater or lesser amount of the centrifugal fan, wherein the two support shafts are located at substantially diametrically opposed positions about the shroud and include support plates fixedly coupled to the shroud, each support plate including a hole for receiving a respective support shaft, each support plate including a plurality of roller bearings arranged to press against the respective support shaft when the support plate is disposed about the respective support shaft.

15. A damper system for controlling a volume of air flow out of a housing having a centrifugal fan that rotates about a rotation axis, comprising:

(a) at least one support shaft;

(b) a damping shroud supported by the support shaft and movable from a cover position coaxially about the centrifugal fan to a noncover position proximate the fan or any position therebetween so as to provide partial cover about the fan thereby permitting or blocking air flow;

(c) an elongate control shaft rotatably mounted proximate the shroud; and (d) a plurality of linkages operatively connecting the control shaft to the shroud whereby rotation of the control shaft about its longitudinal axis causes the shroud to translate along the support shaft so as to cover a greater or lesser amount of the centrifugal fan, wherein the plurality of linkages comprises a first bar coupled to the control shaft, a transfer shaft coupled to the first bar, a second bar coupled to the transfer shaft and a third bar coupled to the second bar, the third bar also being coupled to the shroud, wherein rotation of the control shaft rotates and translates the first bar thereby rotating the transfer shaft thereby rotating the second bar thereby rotating and translating the third bar thereby moving the shroud so as to cover a greater or lesser amount of the fan.

16. The damper system of claim 15 wherein the transfer shaft passes through the housing from an exterior of the housing to an interior of the housing.

17. The damper system of claim 15 wherein the shroud includes a support plate fixedly coupled to the shroud, the support plate including a hole for receiving the support shaft, the plate also including a plurality of bearings arranged to press against the support shaft when the support plate is disposed about the support shaft and wherein the third bar is coupled to the support plate.

18. The damper system of claim 15 further comprising a first torque arm interconnectingly coupled between the control shaft and the first bar.

19. The damper system of claim 18 further comprising a second torque arm interconnectingly coupled between the first bar and the transfer shaft.

* * * * *